US011471902B2

(12) United States Patent
Byun

(10) Patent No.: US 11,471,902 B2
(45) Date of Patent: Oct. 18, 2022

(54) COSMETIC CONTAINER AND PUMPING APPARATUS THEREFOR

(71) Applicant: Sung Jin Cosmetics Co., Ltd., Seoul (KR)

(72) Inventor: Young-Kwang Byun, Seoul (KR)

(73) Assignee: SUNG JIN COSMETICS CO., LTD., Seoul (KR)

( * ) Notice: Subject to any disclaimer, the term of this patent is extended or adjusted under 35 U.S.C. 154(b) by 0 days.

(21) Appl. No.: 17/331,899

(22) Filed: May 27, 2021

(65) Prior Publication Data

US 2021/0394214 A1 Dec. 23, 2021

(30) Foreign Application Priority Data

Jun. 18, 2020 (KR) ..... KR10-2020-0074351

(51) Int. Cl.
*B05B 11/00* (2006.01)
*A45D 34/00* (2006.01)

(52) U.S. Cl.
CPC ..... *B05B 11/3035* (2013.01); *A45D 34/00* (2013.01); *B05B 11/3042* (2013.01); *A45D 2200/051* (2013.01); *A45D 2200/056* (2013.01)

(58) Field of Classification Search
CPC ..... B05B 11/3035; B05B 11/3042; B05B 11/3047; B05B 11/3033; A45D 34/00; A45D 2200/051; A45D 2200/056; A45D 34/04; A45D 2200/057
USPC ..... 222/401
See application file for complete search history.

(56) References Cited

U.S. PATENT DOCUMENTS 3,452,905 A * 7/1969 Micallef ..... B05B 11/3028 222/207
4,220,264 A * 9/1980 Gamadia ..... B05B 9/0883 222/207
5,205,441 A * 4/1993 Andris ..... B05B 11/3035 137/859
5,462,208 A * 10/1995 Stahley ..... B05B 7/0037 222/207
6,536,630 B1 * 3/2003 Chan ..... B05B 11/306 222/207
7,025,233 B2 * 4/2006 Masuda ..... B05B 11/3053 222/207

(Continued)

FOREIGN PATENT DOCUMENTS

KR 101805595 12/2017

*Primary Examiner* — Vishal Pancholi
(74) *Attorney, Agent, or Firm* — Lex IP Meister, PLLC

(57) ABSTRACT

To allow application to a structure in which atmospheric air enters a container and to prevent leakage of cosmetics and allow smooth discharge of the cosmetics, there is provided a cosmetic container including a container main body in which contents are accommodated, a pumping apparatus coupled to an opening at an upper end of the container main body and configured to discharge the contents accommodated in the container main body through a pumping action caused by the inherent elasticity of the pumping apparatus a discharge head which is connected to the pumping apparatus to apply a discharge pressure to the pumping apparatus and has an outlet provided at a front end to communicate with the pumping apparatus and allow the contents to exit, and an inflow tube which is connected to the pumping apparatus and extends to an inner bottom of the container main body to allow the contents to enter.

17 Claims, 6 Drawing Sheets

(56) References Cited

U.S. PATENT DOCUMENTS

| | | | | |
|---|---|---|---|---|
| 2005/0072807 | A1* | 4/2005 | Hsiao | B05B 11/0032 222/251 |
| 2009/0050651 | A1* | 2/2009 | Auer | B05B 11/3069 222/105 |
| 2015/0136810 | A1* | 5/2015 | Ding | B05B 11/3073 222/321.9 |
| 2019/0054486 | A1* | 2/2019 | Deman | B05B 11/3077 |
| 2019/0059549 | A1* | 2/2019 | Byun | B05B 11/3052 |

* cited by examiner

COSMETIC CONTAINER AND PUMPING APPARATUS THEREFOR

CROSS-REFERENCE TO RELATED APPLICATION

This application claims priority to and the benefit of Korean Patent Application No. 10-2020-0074351 filed in the Korean Intellectual Property Office on Jun. 18, 2020, the entire contents of which are incorporated herein by reference.

BACKGROUND OF THE INVENTION

(a) Field of the Invention

The present disclosure relates to a cosmetic container and a pumping apparatus therefor.

(b) Description of the Related Art

For example, liquid cosmetics are contained in a container and discharged from the container for use during makeup application. A liquid cosmetic container includes a pumping apparatus provided inside a container main body, which accommodates contents, to pump and discharge the contents to the outside. The pumping apparatus is pressed by an external force applied by a user, thereby pumping the contents to discharge the contents through an outlet of the container.

Since the pumping apparatus of the cosmetic container has a complex structure and includes a large number of components, the assembly process is complicated, and the manufacturing cost of the cosmetic container is increased.

Thus, the present applicant has improved the conventional pumping structure and developed a cosmetic container in which the number of components is reduced and the structure is simplified and which is capable of smoothly discharging a fixed amount of contents. Korean Patent Registration No. 10-1805595 discloses a liquid cosmetic container which has been developed by the present applicant and for which the present applicant has been granted a patent.

However, the above conventional pumping apparatus is only applicable to a cosmetic container having a structure in which the interior is completely sealed such that there is no inflow of atmospheric pressure. In the case of a cosmetic container that generally requires the inflow of air into the container as contents therein are used, a pumping apparatus having a complex structure is still in use.

In recent years, with a gradual increase in the usage of cosmetics, there is a growing need for a cosmetic container which is cheaper and in which a contents pumping action is satisfactory. Thus, providing a cosmetic container in which the number of components is reduced and the structure is simplified and which is capable of effectively discharging liquid contents in order to meet the need and correspond to the competitive market environment offers numerous advantages to users.

SUMMARY OF THE INVENTION

The present disclosure is directed to providing a cosmetic container and a pumping apparatus therefor capable of being applied to a cosmetic container having a structure in which atmospheric air enters the container and capable of preventing the leakage of cosmetics and allowing smooth discharge of the cosmetics.

The present disclosure is also directed to providing a cosmetic container and a pumping apparatus therefor that are easy to manufacture due to a reduced number of components and a simplified structure.

One aspect of the present disclosure provides a cosmetic container including a container main body in which contents are accommodated, a pumping apparatus coupled to an opening at an upper end of the container main body and configured to discharge the contents accommodated in the container main body through a pumping action caused by the inherent elasticity of the pumping apparatus, a discharge head which is connected to the pumping apparatus to apply a discharge pressure to the pumping apparatus and has an outlet provided at a front end to communicate with the pumping apparatus and allow the contents to exit, and an inflow tube which is connected to the pumping apparatus and extends to an inner bottom of the container main body to allow the contents to enter.

The pumping apparatus may include a housing which is tightly mounted on the opening and in which an operating chamber and a cylinder chamber having different inner diameters are sequentially disposed in an axial direction, a pumping member which is provided in the housing, forms a contents accommodation space, is inherently elastically compressed or expanded in the axial direction to transfer the contents in one direction, and selectively opens or closes a gap between the housing and the pumping member to allow outside air to enter the container main body, and a nozzle member which is installed to be vertically movable in the operating chamber at an upper portion of the housing and which has an upper end connected to the discharge head, a lower end coupled to the pumping member, and a duct through which the contents move formed therein to, according to manipulation of the discharge head, compress the pumping member and selectively open or close between the duct and the space of the pumping member.

The pumping member may include a pressure portion which forms a space therein and is compressed and elastically restored by an external force such that a pressure of the space therein is changed, a mounting portion which is integrally formed with an upper end of the pressure portion and tightly coupled to the nozzle member, a flange which is formed to protrude outward from an outer circumferential surface of a lower portion of the pressure portion and which is pressed against a step between the operating chamber and the cylinder chamber of the housing, a connecting shaft which is formed to extend from a lower end of the pressure portion in the axial direction and which is connected to the inflow tube, a check valve which is integrally formed with an inner side of the lower portion of the pressure portion to allow the contents to enter in one direction from the container main body toward the inside of the pressure portion, an undercut portion which is formed as a step in an inner circumferential surface of a lower end of the mounting portion so that a lower inner diameter is larger than an upper inner diameter and which comes in close contact with the nozzle member to block between the pressure portion and the duct inside the nozzle member, an elastic portion which is integrally formed with the mounting portion and which is compressed and elastically restored by an external force to open or close between the undercut portion and the nozzle member, and a skirt portion which is integrally formed with the outer circumferential surface of the lower portion of the pressure portion and which has an outer diameter gradually increasing toward a lower end thereof to be elastically pressed against an inner surface of the cylinder chamber of the housing.

The pumping member may be made of silicone, rubber, or a synthetic resin.

The pressure portion may have a corrugated structure that is bent one or more times so as to be convex outward.

The elastic portion may be formed to be bent one or more times so as to be convex outward.

The pumping member may have a structure in which an elastic modulus of the elastic portion is relatively higher than that of the pressure portion such that the pressure portion is deformed before the elastic portion when an external force is applied.

The nozzle member may include a nozzle body which is fitted to the operating chamber of the housing and installed to be movable along the operating chamber and which has a duct formed therein to transfer the contents, a connection tube which extends in the axial direction at an upper end of the nozzle body, has the duct formed therein, and is coupled to the discharge head, a fitting portion which is formed at a lower end of the nozzle body and which is fitted to the mounting portion of the pumping member to be tightly coupled thereto, an inflow hole which is formed in a side surface of the fitting portion to allow the duct to communicate with the inside of the elastic portion of the pumping member, and a valve seat which is integrally formed with a lower end of the fitting portion to block a front end of the duct and which comes in close contact with the undercut portion of the pumping member to block between the pressure portion and the elastic portion.

The nozzle member may further include a support plate which is integrally formed with an outer circumferential surface of the nozzle body and which protrudes outward to support an upper end of the mounting portion of the pumping member.

The nozzle body may form, at a position corresponding to the elastic portion, a space which is formed to be recessed inward along the outer circumferential surface and which is spaced apart from the inner circumferential surface of the elastic portion.

At a portion which is formed at the step of the housing and comes in contact with the flange of the pumping member, one or more trench grooves may be formed at predetermined intervals to form a gap with the flange and allow air to enter.

A rim portion which comes in close contact with the flange may be formed along an inner side circumference of the step of the housing, and the trench groove may be formed to extend along the rim portion.

In a non-operational state, the pumping member may be compressed in the axial direction between the step of the housing and the support plate of the nozzle member and may have a structure that is pressed against the step and the support plate.

The pumping apparatus may further include an inner sealing portion configured to increase airtightness between the pumping member and the nozzle member to prevent leakage of the contents.

The inner sealing portion may include a protruding portion which is formed along an outer circumferential surface of the fitting portion and protrudes outward below the inflow hole of the nozzle member and an inner wall which is provided in a space inside the mounting portion of the pumping member, is spaced apart from an inner surface of the mounting portion, and is formed to extend upward from an upper end of the undercut portion to be pressed against the protruding portion and be elastically deformed outward so that a portion between the protruding portion and the inner wall is opened or closed.

DETAILED DESCRIPTION OF EXEMPLARY EMBODIMENTS

Figure 1:
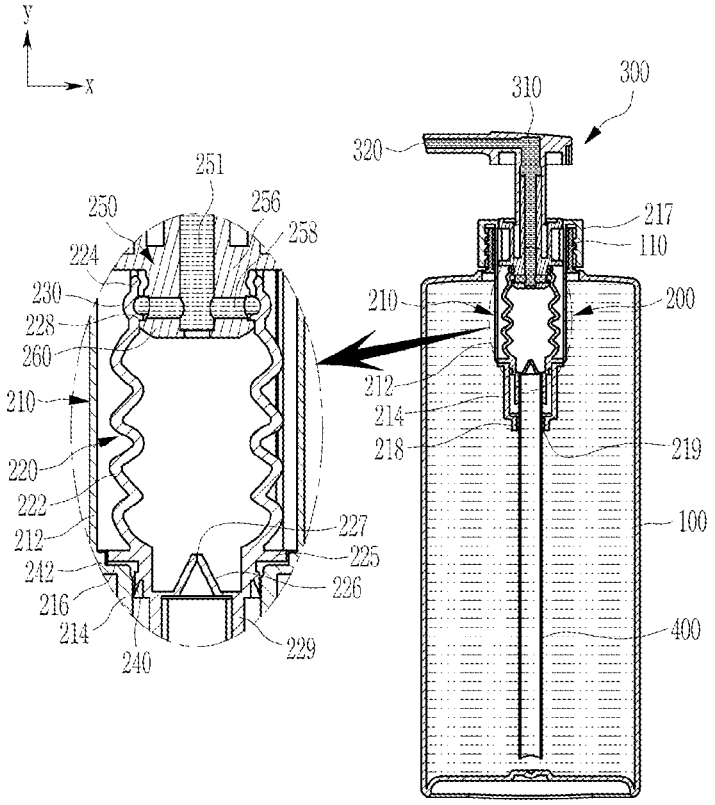
FIG. 1 is a schematic cross-sectional view illustrating a cosmetic container according to an embodiment.

Hereinafter, an embodiment of the present disclosure will be described in detail. However, this is provided as an example and the present disclosure is not limited thereto and is defined only by the scope of the claims below. The embodiment which will be described below may be modified in various forms without departing from the concept and scope of the present disclosure. The same or similar parts will be denoted by the same reference numerals in the drawings as much as possible.

The technical terms used herein are only for referring to specific embodiments and are not intended to limit the present disclosure. Singular expressions used herein include plural expressions unless the context clearly indicates otherwise. The term "comprising" used herein specifies a particular characteristic, region, integer, stage, operation, element and/or component and is not intended to exclude the presence or addition of another particular characteristic, region, integer, stage, operation, element, component, and/or group.

Hereinafter, an exemplary embodiment of the present disclosure will be described with reference to the drawings. However, the following embodiment is only an exemplary embodiment of the present disclosure and the present disclosure is not limited thereto.

Figure 2:
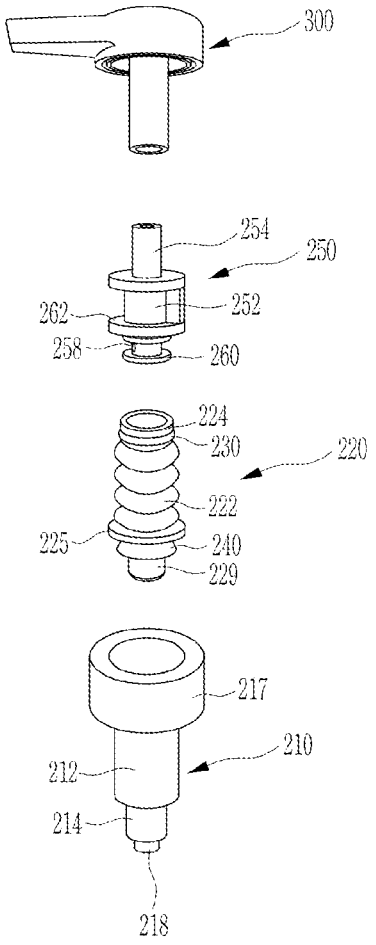
FIG. 2 is a schematic perspective view illustrating a pumping apparatus of the cosmetic container according to the embodiment.
Figure 3:
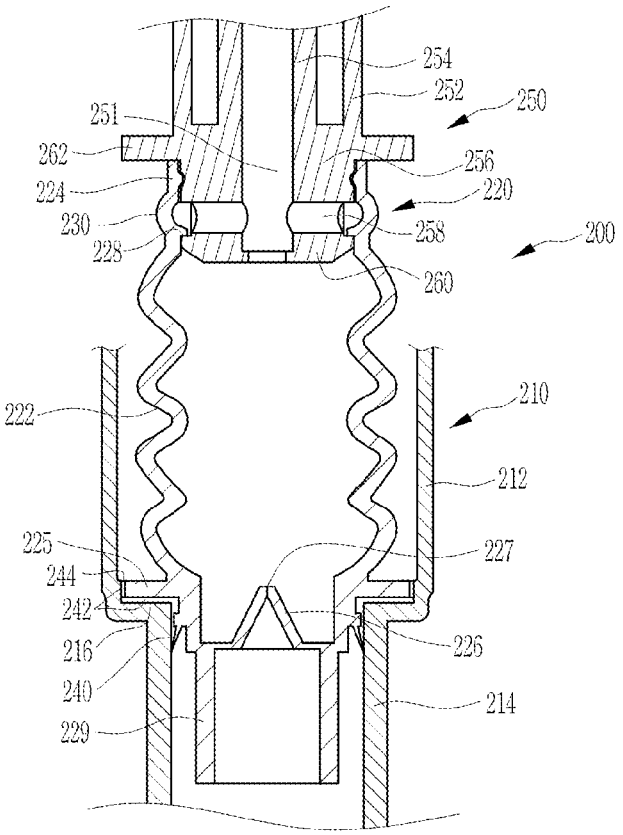
FIG. 3 is a schematic cross-sectional view of the pumping apparatus of the cosmetic container according to the embodiment.

FIG. 1 illustrates a cosmetic container according to a first embodiment, and FIGS. 2 and 3 illustrate a pumping apparatus for the cosmetic container.

In the following description, "axial direction" may refer to a direction along which a central axis line passes and may indicate the y-axis direction in FIG. 1, and when the cosmetic container is placed on a floor as illustrated in FIG. 1, "on," "above," or "upward direction" may refer to an upper side along the y-axis direction, and "under," "below," or "downward direction" may refer to a lower side which is the opposite of the upper side.

As illustrated, the cosmetic container according to the embodiment may include a container main body 100, a pumping apparatus 200, a discharge head 300, and an inflow tube 400.

The container main body 100 may be a cylindrical structure having a space formed therein to accommodate contents. The space inside the container main body 100 may be filled with various kinds of cosmetics (hereinafter referred to as "contents"). The contents may also be quasi-drug products such as a disinfectant or household items such as a detergent, other than cosmetics. The form of the container main body 100 may be modified in various ways.

The container main body 100 has an opening 110 formed at an upper end. The opening 110 at the upper end of the container main body 100 is connected to the pumping apparatus 200. Thus, the contents accommodated in the container main body 100 are discharged from the opening 110 by the pumping apparatus 200 and discharged to the outside through the discharge head 300.

As the contents of the container main body 100 are discharged by the pumping apparatus 200, outside air may enter the container main body 100 through the pumping apparatus 200. Thus, an internal pressure of the container main body 100 may become equal to an atmospheric pressure, and an outer shape of the container main body 100 may be continuously maintained.

The pumping apparatus 200 may be detachably coupled to the opening 110 at the upper end of the container main body 100. For example, male threads may be formed on an outer circumferential surface of the opening 110 at the upper end of the container main body 100, female threads may be formed on an inner circumferential surface of the pumping apparatus 200, and the male threads and female threads may be coupled to each other by screw fastening. The pumping apparatus 200 and the opening 110 of the container main body 100 may be coupled to each other using various methods other than screw coupling, and the coupling method is not particularly limited.

The discharge head 300 is coupled to the pumping apparatus 200 and applies pressure to the pumping apparatus 200 to drive the pumping apparatus 200. In the embodiment, the discharge head 300 may have a structure that is vertically pressed to drive the pumping apparatus 200. The discharge head 300 has a duct 310 formed therein to be connected to the pumping apparatus 200. An outlet 320 through which the contents transferred through the duct 310 exit is formed at a front end of the discharge head 300. Thus, when a user presses the discharge head 300, the discharge head 300 applies pressure to the pumping apparatus 200 to drive the pumping apparatus 200. Therefore, the contents discharged by the pumping apparatus 200 are discharged to the front end of the discharge head 300 along the duct of the discharge head 300 through the outlet 320. The form of the discharge head 300 may be modified in various ways.

The inflow tube 400 has a hollow tube structure to allow the contents to move. The inflow tube 400 may be connected to the pumping apparatus 200 and longitudinally extend to an inner bottom of the container main body 100. According to driving of the pumping apparatus 200, the contents are suctioned into the pumping apparatus 200 through the inflow tube 400.

The pumping apparatus 200 is coupled to the opening 110 at the upper end of the container main body 100 and transfers the contents accommodated in the container main body 100 to the discharge head 300 according to operation of the discharge head 300.

Through a pumping action due to the inherent elasticity of the pumping apparatus 200, the pumping apparatus 200 may change the internal pressure to discharge the contents of the container main body 100.

A configuration of the pumping apparatus will be described with reference to FIGS. 2 and 3.

The pumping apparatus 200 according to the embodiment may include a housing 210, a pumping member 220, and a nozzle member 250.

The housing 210 forms the exterior of the pumping apparatus 200 and operably supports each constituent part therein.

The housing 210 is a cylindrical structure having open upper and lower portions. The housing 210 is tightly mounted on the opening 110 of the container main body 100 and has a structure in which an inner diameter varies in the axial direction. Hereinafter, portions having different diameters will be referred to as an operating chamber 212 and a cylinder chamber 214, respectively. The operating chamber 212 is a portion where the nozzle member 250 is installed to be vertically movable, and the cylinder chamber 214 below the operating chamber 212 is a portion with which a skirt portion 240 of the pumping member 220 that will be described below comes in close contact.

A step 216 is horizontally formed along a diameter difference between the operating chamber 212 having a relatively larger diameter and the cylinder chamber 214 having a relatively smaller diameter. A flange 225 formed at a lower portion of the pumping member 220 comes in contact with the step 216 so as to be supported thereby.

A female thread member 217 for fastening to the opening 110 of the container main body 100 may be further provided on an outer side of an upper end of the operating chamber 212. Thus, when the female thread member 217 is fastened to the opening 110 of the container main body 100, the pumping member 220 is coupled to the container main body 100. An O-ring for maintaining airtightness may be further installed between the female thread member 217 and the opening 110 of the container main body 100.

A support portion 218 configured to support the inflow tube 400 coupled to the pumping member 220 may be further formed at a lower end of the cylinder chamber 214 of the housing 210. A plurality of ribs 219 may be formed to inwardly protrude along an inner circumferential surface of the support portion 218 to support the inflow tube 400. A gap may be formed between the support portion and the inflow tube 400 due to the ribs 219, and thus air may more smoothly enter the container main body 100 through the gap.

In the housing 210, the female thread member 217, the operating chamber 212, the cylinder chamber 214, and the support portion 218 may be integrally formed and constitute a single body. Thus, the number of components is reduced and manufacturing is facilitated.

The pumping member 220 is installed inside the housing 210.

The nozzle member 250 is installed at an upper end of the pumping member 220, and the inflow tube 400 is connected to a lower end of the pumping member 220. Thus, the pumping member 220 selectively connects between the inside of the container main body 100 and a duct 251 of the nozzle member 250 to transfer the contents to the nozzle member 250. Also, the pumping member 220 selectively connects between the outside and inside of the container main body 100 to allow outside air to enter the container main body 100.

To this end, the pumping member 220 may include a pressure portion 222 which forms a space therein and is compressed and elastically restored by an external force such that a pressure of the space therein is changed, a mounting portion 224 which is integrally formed with an upper end of the pressure portion 222 and tightly coupled to the nozzle member 250, the flange 225 which is formed to protrude outward from an outer circumferential surface of a lower portion of the pressure portion 222 and which is pressed against the step 216 between the operating chamber 212 and the cylinder chamber 214 of the housing 210, a check valve 226 which is integrally formed with an inner side of the lower portion of the pressure portion 222 to allow the contents to enter in one direction from the container main body 100 toward the inside of the pressure portion 222, an undercut portion 228 which is formed as a step in an inner circumferential surface of a lower end of the mounting portion 224 so that a lower inner diameter is larger than an upper inner diameter and which comes in close contact with the nozzle member 250 to block between the pressure portion 222 and the duct 251 inside the nozzle member 250, an elastic portion 230 which is integrally formed with the mounting portion 224 and which is compressed and elastically restored by an external force to open or close between the undercut portion 228 and the nozzle member 250, and the skirt portion 240 which is integrally formed with the outer circumferential surface of the lower portion of the pressure portion 222 and which has an outer diameter gradually increasing toward a lower end thereof to be elastically pressed against an inner surface of the cylinder chamber 214 of the housing 210.

Thus, the pumping member 220 may be inherently compressed or elastically restored and change the pressure of the space therein to transfer the contents in one direction and may selectively open or close the gap with the cylinder chamber 214 of the housing 210 to allow outside air to enter the container main body 100.

The pumping member 220 may be made of an elastic material to enable compression and expansion due to elasticity. For example, the pumping member 220 may be made of rubber, silicone, a synthetic resin, or the like. "Compression" may refer to a reduction in volume from an original state due to being pressed by an external force. "Expansion" may refer to restoration to the original state from the compressed state due to an increase in volume. In this way, since the pumping member 220 has inherent elasticity, when the external force applied to the pumping member 220 is removed in a state in which the pumping member 220 is elastically deformed due to the external force, the pumping member 220 may be restored to its original state due to an inherent elastic restoration force.

Also, a connecting shaft 229 which is formed to extend in the axial direction and connected to the inflow tube 400 may be further formed at a lower end of the pressure portion 222. The connecting shaft 229 connects the inflow tube 400 to the pumping member 220. The inflow tube 400 may be forcibly fitted and coupled to the connecting shaft 229.

The pumping member 220 according to the embodiment may have a structure in which the pressure portion 222, the mounting portion 224, the flange 225, the connecting shaft 229, the check valve 226, the undercut portion 228, the elastic portion 230, and the skirt portion 240 are integrally formed. Thus, the pumping member 220 consists of a single component in which all the constituent parts are integrally formed. Therefore, the number of components of the apparatus may be reduced, and the apparatus may be easily manufactured at a lower cost.

Through compression and expansion due to inherent elasticity according to driving of the discharge head 300, the pressure portion 222 changes the pressure of the space therein.

The pressure portion 222 according to the embodiment may be formed in the shape of a circular corrugated tube that is continuously bent one time or more so as to be convex outward. The space formed in the pressure portion 222 communicates with the check valve 226 located right below the space. The contents entering from the check valve 226 are accommodated in the space formed in the pressure portion 222.

The pressure portion 222 may be formed in the shape of a multi-stage corrugated tube that is continuously bent multiple times according to the size of the space or the amount of contents pumped by the pressure portion 222. The corrugated shape, length, diameter, or the like of the pressure portion 222 may be modified in various ways.

The pressure portion 222 performs a pumping action as the corrugated portion is elastically deformed and the space therein is compressed or expanded to change the pressure. The pressure portion 222 is compressed due to an external force pressing the discharge head 300 and applies a discharge pressure to the contents, and when the external force is removed, the pressure portion 222 is restored to its original state due to an inherent elastic restoration force and applies a suction pressure to the contents of the container main body 100. Thus, the pressure portion 222 may pump out the contents while being compressed and expanded without including a separate spring.

When an external force is applied to the pumping member 220 according to driving of the discharge head 300, a force is transmitted to the pressure portion 222 and, as the pressure portion 222 is elastically deformed, the space therein is compressed. As the pressure portion 222 continues to be compressed, the pressure of the space in the pressure portion 222 increases. The pressure of the space therein becomes relatively higher than the pressure inside the container main body 100, and thus the check valve 226 maintains a closed state. The contents receiving pressure due to compression of the pressure portion 222 are finally discharged to the discharge head 300 through the nozzle member 250.

When the external force applied to the pumping member 220 is removed, the pressure portion 222 is expanded due to an inherent elastic force and is restored to its original shape. As the space in the pressure portion 222 expands, the pressure therein becomes relatively lower than the pressure inside the container main body 100. Thus, the check valve 226 is opened, and the contents accommodated in the container main body 100 enter the space in the pressure portion 222 through the check valve 226 such that the space is filled with the contents.

The check valve 226 that allows the contents of the container main body 100 to enter the pressure portion 222 only in one direction is integrally formed with the inner side of the lower portion of the pressure portion 222.

The check valve 226 is opened or closed as a hole thereof is widened or closed due to the pressure in the pumping member 220. In the embodiment, the check valve 226 may have a conical shape in which both sides extending upward are formed to be inclined to form a sharp upper end and may have a structure in which both sides forming the sharp upper end come in contact with each other while a hole 227 in the shape of a slit is formed therebetween. Thus, the hole 227 of the check valve 226 is opened or closed as the upper ends of both sides of the check valve 226, which come in contact with each other, are elastically pressed against or move away from each other.

The check valve 226 is opened or closed according to a change in the pressure in the pumping member 220 and transfers the contents from the container main body 100 toward only the pumping member 220. That is, when the pressure in the pumping member 220 becomes relatively lower than the pressure inside the container main body, the hole 227 at the front end of the check valve 226 is widened and opened. Thus, the contents of the container main body 100 enter the pumping member 220 through the hole 227 of the check valve 226. Conversely, when the pressure in the pumping member 220 becomes relatively higher than the pressure inside the container main body, the hole 227 in the shape of a slit is closed due to pressure applied to the check valve 226. Thus, the contents in the pumping member 220 are unable to move toward the container main body 100.

The mounting portion 224 constitutes an upper end of the pumping member 220 and is fitted and coupled to the nozzle member 250. The mounting portion 224 may be installed to be pressed against the nozzle member 250. The mounting portion 224 is integrally formed with an upper portion of the pressure portion 222. The mounting portion 224 selectively communicates with the duct 251 in the nozzle member 250.

The mounting portion 224 is a cylindrical tube structure and extends from the pressure portion 222 in the axial direction to constitute an upper end portion of the pumping member 220. The nozzle member 250 is installed to be inserted into the mounting portion 224 through an open front end of the mounting portion 224. The mounting portion 224 may be elastically fitted and coupled to the nozzle member 250. Thus, an inner surface of the mounting portion 224 is pressed against an outer surface of the nozzle member 250 and sealed.

Also, an upper end of the mounting portion 224 is pressed against a support plate 262 of the nozzle member 250 that will be described below. Therefore, since the mounting portion 224 is pressed against the outer circumferential surface of the nozzle member 250 and the support plate 262 and sealed, leakage of the contents may be prevented.

The undercut portion 228 is formed on an inner circumferential surface of the mounting portion 224. The undercut portion 228 is processed to be stepped so that an inner diameter of a lower side portion is increased from the inner circumferential surface of the mounting portion 224. Thus, an upper side of the undercut portion 228 constitutes the inner circumferential surface of the mounting portion 224, and the inner diameter of the inner side surface of the undercut portion 228 is formed to be larger than an inner diameter of the inner circumferential surface of the mounting portion 224 at the upper side.

A valve seat 260 of the nozzle member 250 that will be described below is placed on a horizontal stepped surface of the undercut portion 228 so as to come in close contact therewith. An inner diameter of the undercut portion 228 which is processed to be stepped may be formed to be larger than an outer diameter of the valve seat 260. Thus, during expansion and contraction of the mounting portion 224, interference between an inner circumferential surface of the undercut portion 228 and the valve seat 260 may be minimized.

The stepped surface of the undercut portion 228 comes in close contact with the valve seat 260 of the nozzle member 250 to block between the pumping member 220 and the nozzle member 250 and is spaced apart from the valve seat 260 to form a passage for the contents.

In a state in which the upper end of the mounting portion 224 is supported by the support plate 262 of the nozzle member 250, the horizontal stepped surface of the undercut portion 228 is elastically pressed against the valve seat 260 of the nozzle member 250. Thus, the undercut portion 228 of the mounting portion 224 may be pressed against the valve seat 260 to maintain a closed state between the two members.

An axial length of the mounting portion 224, that is, a length between the upper end of the mounting portion 224 and the stepped surface of the undercut portion 228, is changed due to elastic deformation of the elastic portion 230. As the length of the mounting portion 224 is changed, a portion between the undercut portion 228 and the valve seat 260 is opened or closed.

To this end, the elastic portion 230 according to the embodiment is integrally formed with a side surface of the mounting portion 224 and is elastically deformed according to driving of the discharge head 300 to increase or decrease the axial length of the mounting portion 224.

The elastic portion 230 is compressed or expanded in the axial direction of the mounting portion 224 due to inherent elasticity according to driving of the discharge head 300. As the mounting portion 224 is expanded and contracted according to the compression and expansion of the elastic portion 230, the overall length of the mounting portion 224 is changed in the axial direction.

The elastic portion 230 may be formed in the shape of a wrinkle having a thickness smaller than a cross-sectional thickness of the mounting portion 224 to allow the elastic portion 230 to be compressed and deformed when an external force is applied thereto and the elastic portion 230 is pressed. Thus, the length of the mounting portion 224 may be changed as the elastic portion 230 of the mounting portion 224 is easily elastically deformed. The elastic portion 230 may be formed in the shape of a single wrinkle that is bent to be convex outward. The shape of the wrinkle of the elastic portion 230 is not limited to the single wrinkle, and the elastic portion 230 may also be formed by bending into the shape of multiple wrinkles like a bellows.

As the elastic portion 230 is elastically compressed due to an external force applied to the discharge head 300, the axial length of the mounting portion 224 is decreased. Thus, as the undercut portion 228 is moved relative to the valve seat 260, the horizontal stepped surface of the undercut portion 228 and the valve seat 260 are spaced apart from each other, and a gap is formed therebetween. Therefore, a portion between the pumping member 220 and the nozzle member 250 may be opened, and the contents may be discharged to the nozzle member 250 through the gap.

When the external force applied to the pumping member 220 is removed, the elastic portion 230, which has been compressed, is restored to its original state due to an inherent elastic restoration force, and the axial length of the mounting portion 224 is expanded to the original length. Thus, as the undercut portion 228 is moved relative to the valve seat 260, the horizontal stepped surface of the undercut portion 228 comes in close contact with the valve seat 260. Therefore, as the portion between the undercut portion 228 and the valve seat 260 is closed, the discharge of the contents is blocked.

In the embodiment, the elastic portion 230 has a structure having a relatively higher elastic modulus than the pressure portion 222. Since the pumping member 220 consists of a single body made of the same material, the shapes, cross-sectional structures, or the like of the elastic portion 230 and the pressure portion 222 may be made different so that the elastic moduli thereof are different. For example, a thickness of a cross-sectional rim of the elastic portion 230 may be formed to be thicker than a thickness of a cross-sectional rim of the pressure portion 222 so that the elastic moduli of the elastic portion 230 and the pressure portion 222 are different.

Thus, when an external force is applied to the pumping member 220, the pressure portion 222 having a relatively lower elastic modulus may be compressed and deformed before the elastic portion 230. As the external force continues to be applied after the pressure portion 222 is elastically deformed, the elastic portion 230 having a relatively higher elastic modulus than the pressure portion 222 is compressed and deformed. As the elastic portion 230 is compressed and deformed and the length thereof is contracted, the portion between the undercut portion 228 and the valve seat 260 is opened. Thus, the contents in a pressurized state in the pressure portion 222 are discharged to the nozzle member 250 through the portion between the undercut portion 228 and the valve seat 260.

Conversely, when the external force applied to the pumping member 220 is removed, the elastic portion 230 having a relatively higher elastic modulus is expanded and deformed first and restored to its original state due to an elastic restoration force. As the elastic portion 230 is restored to its original state and the length thereof is expanded, the valve seat 260 comes in close contact with the stepped surface of the undercut portion 228, and the portion between the two members is blocked. After the elastic portion 230 is restored to its original state, the pressure portion 222 is expanded and deformed and restored to its original state due to an elastic restoration force. As the pressure portion 222 is expanded and deformed, a negative pressure is formed in the space therein. Since the undercut portion 228 and the valve seat 260 are in close contact and thus the portion therebetween is closed, due to the negative pressure of the pressure portion 222, the contents of the container main body 100 enter the space in the pressure portion 222 through the check valve 226.

As the pressure portion 222 and the elastic portion 230 are sequentially driven as described above, the contents pumping action may be smoothly performed.

The flange 225 is integrally formed with the lower portion of the pressure portion 222 of the pumping member 220. The flange 225 is formed to protrude outward from an outer circumferential surface of the pressure portion 222. The flange 225 is caught on the step 216 of the housing 210 and serves as a stopper that supports the pumping member 220 on the housing 210. The flange 225 is pressed against the step 216 of the housing 210.

Thus, the pumping member 220 may be installed in the housing 210 in a state in which the pumping member 220 is pressed between the step 216 of the housing 210 and the support plate 262 of the nozzle member 250 coupled to the housing 210 and the upper and lower ends of the pumping member 220 are elastically pressed against the step 216 and the support plate 262. Therefore, due to an inherent elastic force of the pumping member 220, the flange 225 maintains a state of being pressed against the step 216 at a predetermined pressure.

Also, the skirt portion 240 which is elastically pressed against the inner surface of the cylinder chamber 214 is integrally formed with the outer circumferential surface of the lower portion of the pressure portion 222 that extends to the inside of the cylinder chamber 214 of the housing 210.

The skirt portion 240 selectively opens or closes the cylinder chamber 214 as necessary. Due to the skirt portion 240, outside air enters the container main body 100, and the container main body 100 is filled therewith. Thus, the space which is emptied as the contents of the container main body 100 are discharged may be filled with outside air. Therefore, the internal pressure of the container main body 100 may become equal to the atmospheric pressure, and the shape of the container main body 100 may be continuously maintained.

The skirt portion 240 is continuously formed along an outer circumferential surface of the lower end of the pressure portion 222. The skirt portion 240 has a structure in which an outer diameter gradually extends toward the lower end. The skirt portion 240 may be more smoothly deformed because the thickness thereof gradually decreases toward the lower end. Thus, as a front end portion of the skirt portion 240 is easily elastically deformed outward and comes in close contact with the inner surface of the cylinder chamber 214 of the housing 210, the skirt portion 240 prevents leakage of the contents of the container main body 100 through a portion between the skirt portion 240 and the cylinder chamber 214. Also, as the front end portion of the skirt portion 240 is easily elastically deformed inward and forms a gap with the inner surface of the cylinder chamber 214 of the housing 210, the skirt portion 240 may allow outside air to enter the container main body 100 through the gap with the cylinder chamber 214.

The skirt portion 240 is installed at an outer side of the pumping member 220 and opens or closes the portion between the pumping member 220 and the housing 210. Since the inside of the housing 210 communicates with the outside through the gap with the nozzle member 250, the outside and inside of the container main body 100 may communicate through the housing 210 according to opening and closing of the skirt portion 240.

The skirt portion 240 widens outward and is more tightly pressed against the inner surface of the cylinder chamber 214 of the housing 210 when the internal pressure of the container main body 100 is relatively higher than the external pressure. Therefore, when the pumping member 220 is compressed or the container main body 100 is pressed such that the internal pressure is increased, the skirt portion 240 comes in close contact with the cylinder chamber of the housing 210 such that the gap is blocked and the contents do not leak to the outside of the housing 210.

Conversely, in a case in which the check valve 226 is opened according to operation of the pumping member 220 and the contents of the container main body 100 enter the pumping member 220, the internal pressure of the container main body 100 becomes lower than the external atmospheric pressure.

Thus, as outside air which is under a relatively higher pressure flows into the container main body 100, which is under a relatively lower pressure, due to the pressure difference, the skirt portion 240 is elastically deformed inward, and a gap is widened between the skirt portion 240 and the inner surface of the cylinder chamber 214 of the housing 210.

Therefore, outside air may enter the housing 210 and enter the container main body 100 through the gap between the skirt portion 240 and the inner surface of the cylinder chamber 214.

As outside air enters the container main body 100, the space inside the container main body 100, from which the contents are discharged, is filled with the outside air. Therefore, the container main body 100 may continuously maintain its original shape without being dented.

In this way, through the skirt portion 240 integrally formed with the pumping member 220, leakage of the contents may be completely blocked very easily and conveniently through its structure, and outside air may be allowed to enter the container main body 100.

The pumping apparatus 200 according to the embodiment has a structure that allows outside air to more smoothly enter the container main body 100. To this end, at least one or more trench grooves 242 may be further formed in the step 216 of the housing 210 that comes in contact with the flange 225 of the pumping member 220.

The trench groove 242 forms a gap through which air enters between the step 216 and the flange 225.

The trench groove 242 may be formed to be recessed in the horizontal surface of the step 216 that comes in contact with the flange 225 of the pumping member 220. The trench groove 242 may be provided as a plurality of trench grooves 242 formed at predetermined intervals in the circumferential direction. Thus, the trench groove 242 may form a gap between the horizontal surface of the step 216 and the flange 225, which are pressed against each other, to serve as a passage for air inflow.

Also, a rim portion 244 may be formed along an inner side circumference of the step 216 of the housing 210 so as to come in close contact with the flange 225, and the trench groove 242 may be formed to extend along the rim portion 244. The rim portion 244 may be understood as a portion that is formed to be thicker and protrudes inward on the inner surface of the operating chamber 212 of the housing 210.

Thus, since the flange 225 is installed to come in close contact with the rim portion 244 formed on the inner surface of the operating chamber 212 of the housing 210 and is formed to be perpendicular to the rim portion 244, outside air may smoothly enter through the trench groove 242 extending to the step 216.

In this way, the pumping member 220 according to the embodiment is installed in the housing 210, and the skirt portion 240 easily selectively blocks between the housing 210 and the pumping member 220 to block leakage of the contents and allow outside air to enter.

The nozzle member 250 is installed to be vertically movable in the operating chamber 212 at the upper portion of the housing 210 and has an upper end connected to the discharge head 300 and a lower end coupled to the pumping member 220. The nozzle member 250 has the duct 251 through which the contents move formed therein to, according to manipulation of the discharge head 300, compress the pumping member 220 and selectively open or close between the duct 251 and the space of the pumping member 220.

The nozzle member 250 is coupled to the mounting portion 224 formed at the upper portion of the pumping member 220 to connect between the pumping member 220 and the discharge head 300. The nozzle member 250 has the duct 251 formed therein to constitute a contents movement passage. The duct 251 communicates with the outlet 320 through the inside of the discharge head 300.

The nozzle member 250 compresses the pumping member 220 and selectively opens or closes between the elastic portion 230 and the undercut portion 228 according to driving of the discharge head 300.

To this end, the nozzle member 250 according to the embodiment may include a nozzle body 252 which is fit to the operating chamber 212 of the housing 210 and installed to be movable along the operating chamber 212 and which has the duct 251 formed therein to transfer the contents, a connection tube 254 which extends in the axial direction at an upper end of the nozzle body 252, has the duct 251 formed therein, and is coupled to the discharge head 300, a fitting portion 256 which is formed at a lower end of the nozzle body 252 and which is fitted to the mounting portion 224 of the pumping member 220 to be tightly coupled thereto, an inflow hole 258 which is formed in a side surface of the fitting portion 256 to allow the duct 251 to communicate with the inside of the elastic portion 230 of the pumping member 220, and the valve seat 260 which is integrally formed with a lower end of the fitting portion 256 to block a front end of the duct 251 and which comes in close contact with the undercut portion 228 of the pumping member 220 to block between the pressure portion 222 and the elastic portion 230.

The nozzle member 250 may further include the support plate 262 which is integrally formed with an outer circumferential surface of the nozzle body 252 and which protrudes outward to support the upper end of the mounting portion 224 of the pumping member 220.

The nozzle member 250 may be installed to be movable in the axial direction inside the operating chamber 212 of the housing 210.

The connection tube 254 and the nozzle body 252 constitute a single tubular structure that extends as one body. The duct 251 through which the contents are transferred is formed as one body inside the connection tube 254 and the nozzle body 252. The connection tube 254 is fitted to the discharge head 300 and connected to the outlet 320.

The nozzle body 252 is formed in a cylindrical shape having a diameter that corresponds to the operating chamber 212 of the housing 210. The nozzle body 252 may be installed to be inserted into the operating chamber 212 so as not to fall out of the operating chamber 212. For example, a protrusion may be formed to inwardly protrude along an inner circumferential surface of the upper end of the operating chamber 212 of the housing 210 so that an upper end of the nozzle body 252 that is inserted into the operating chamber 212 is caught at the protrusion. Thus, when the nozzle body 252 is fitted to the operating chamber 212, the nozzle member 250 does not deviate upward from the housing 210.

In a state in which the nozzle member 250 is coupled to the operating chamber 212 of the housing 210, as mentioned above, the upper end of the pumping member 220 is supported by the support plate 262 which is formed to protrude outward from the nozzle body 252. Thus, the lower end of the pumping member 220 is supported on the step 216 of the housing 210 by the flange 225, and the upper end of the pumping member 220 is supported by the support plate 262 of the nozzle member 250. Therefore, the pumping member 220 is elastically installed between the support plate 262 of the nozzle member 250 and the step 216 of the housing 210.

The fitting portion 256 fitted to the mounting portion 224 of the pumping member 220 so as to be tightly coupled thereto is integrally formed with the lower end of the nozzle body 252. A groove and a protrusion engaged with and coupled to each other may be further formed between the fitting portion 256 and the mounting portion 224.

On an outer side surface of the fitting portion 256, a space which is formed to be recessed inward along the outer circumferential surface and which is spaced apart from the inner circumferential surface of the elastic portion 230 may be formed at a position that corresponds to the elastic portion 230. Thus, the fitting portion 256 is spaced apart from the inner surface of the elastic portion 230 of the pumping member 220 without coming in contact therewith, and the fitting portion 256 and the inner surface of the elastic portion 230 do not interfere with each other. Therefore, the elastic portion 230 may be smoothly elastically deformed, and the contents of the pumping member 220 may smoothly enter between the mounting portion 224 and the nozzle body 252.

The inflow hole 258 may be formed in the recessed side surface of the fitting portion 256. The inflow hole 258 may be provided as one or more inflow holes 258 formed at predetermined intervals along the outer circumferential surface of the fitting portion 256. Thus, the contents entering between the mounting portion 224 and the fitting portion 256 may be moved to the duct 251 inside the nozzle body 252 through the inflow hole 258.

The valve seat 260 is integrally formed with the lower end of the fitting portion 256 of the nozzle body 252. The valve seat 260 comes in close contact with the horizontal stepped surface of the undercut portion 228 to block between the inside of the pressure portion 222 and the duct 251 inside the nozzle body 252.

As illustrated in FIG. 3, the valve seat 260 is formed to protrude outward from the lower end of the fitting portion 256. A diameter of the valve seat 260 may be formed to have a size that allows the valve seat 260 to be inserted into the undercut portion 228. An upper surface of the valve seat 260 is pressed against the horizontal stepped surface of the undercut portion 228.

As mentioned above, the upper end of the mounting portion 224 is elastically installed at the support plate 262 of the nozzle member 250. In a state in which the mounting portion 224 is supported by the support plate 262, the undercut portion 228 may be pressed against the valve seat 260 at a predetermined pressure due to the elastic force of the elastic portion 230 formed at the mounting portion 224. Thus, the portion between the valve seat 260 and the undercut portion 228 is blocked. Therefore, movement of the contents from the space inside the pressure portion 222 at the lower side toward the space inside the elastic portion 230 at the upper side is blocked.

When the elastic portion 230 is elastically deformed to a compressed state according to driving of the discharge head 300, the length of the mounting portion 224 is contracted. Thus, the valve seat 260 of the nozzle member 250 and the undercut portion 228 are spaced apart from each other, a gap is formed therebetween, and the contents may move through the gap between the two members.

Hereinafter, actions according to the embodiment will be described with reference to FIGS. 4 and 5.

Figure 4:
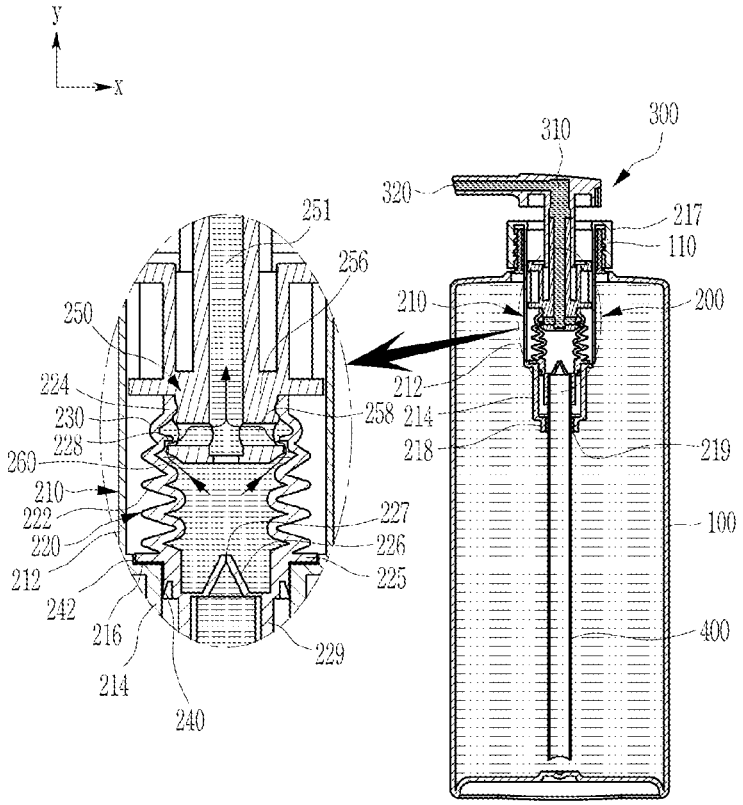
FIGS. 4 and 5 are schematic views illustrating operational states of the pumping apparatus of the cosmetic container according to the embodiment.

FIG. 4 illustrates a state in which the contents of the container main body 100 are discharged as the pumping member 220 is compressed.

When the user presses the discharge head 300, the nozzle member 250 connected to the discharge head 300 moves downward along the operating chamber 212 of the housing 210. The pumping member 220 is elastically compressed according to movement of the nozzle member 250.

As the pumping member 220 is compressed and the internal pressure of the pressure portion 222 increases, the check valve 226 maintains a closed state. In this state, when the discharge head 300 is continuously pressed and the nozzle member 250 continues to move, the elastic portion 230 is elastically compressed, the valve seat 260 in close contact with the undercut portion 228 is spaced apart from the undercut portion 228, and the portion between the undercut portion 228 and the valve seat 260 is opened.

Therefore, the contents receiving pressure in the space in the pressure portion 222 enter the mounting portion 224 through the open portion between the undercut portion 228 and the valve seat 260. Then, the contents enter the duct 251 in the nozzle body 252 through the inflow hole 258 of the nozzle body 252 and are discharged through the outlet 320 of the discharge head 300.

Here, the skirt portion 240 is in close contact with the inner surface of the cylinder chamber 214 of the housing 210, and the contents inside the housing 210 do not leak to the outside through a portion between the housing 210 and the skirt portion 240.

The operating chamber 212 of the housing 210 communicates with the outside and maintains an atmospheric pressure therein regardless of compression of an elastic member. Since the check valve 226 is closed, the contents of the container main body 100 are unable to be discharged into the elastic member. Thus, negative pressure is not formed inside the container main body 100 communicating with the operating chamber 212. Therefore, the skirt portion 240 maintains a state of coming in close contact with the inner surface of the cylinder chamber 214 of the housing 210.

Thus, the contents are not discharged to the outside through the portion between the housing 210 and the pumping member 220.

Figure 5:
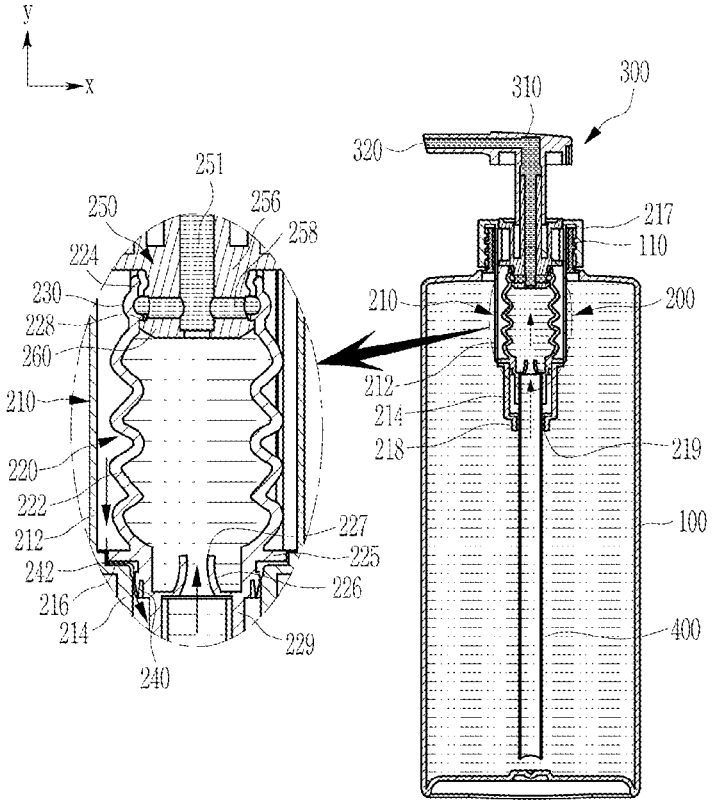

FIG. 5 illustrates a state in which the pumping member 220 is restored to its original state.

When an external force pressing the discharge head 300 is removed, the discharge head 300 is restored to its original state due to the elastic restoration force of the pumping member 220. First, as the elastic portion 230 which is compressed is restored to its original state due to the elastic restoration force, the nozzle member 250 moves upward, and the valve seat 260 comes in close contact with the undercut portion 228.

Thus, the portion between the undercut portion 228 and the valve seat 260 is blocked. Then, the pressure portion 222 which is compressed is also restored to its original state as it expands due to the elastic restoration force.

As the compressed pressure portion 222 expands to its original state, the contents accommodated in the container main body 100 are suctioned into the inflow tube 400 and enter the space in the pressure portion 222 through the check valve 226 so that the space is refilled with the contents.

As the contents of the container main body 100 enter the pumping member 220, the internal pressure of the container main body 100 is decreased. Thus, outside air with a relatively higher pressure applies pressure to the skirt portion 240, and the skirt portion 240 is elastically deformed inward such that a gap is widened between the skirt portion 240 and the inner surface of the cylinder chamber 214 of the housing 210.

Therefore, outside air is circulated through the trench groove 242 formed in the step 216 of the housing 210 and flows from the operating chamber 212 toward the cylinder chamber 214. Thus, outside air enters the container main body 100.

The space inside the container main body 100, from which the contents are discharged after entering, is filled with outside air. Therefore, the container main body 100 may continuously maintain its original shape without being dented.

Figure 6:
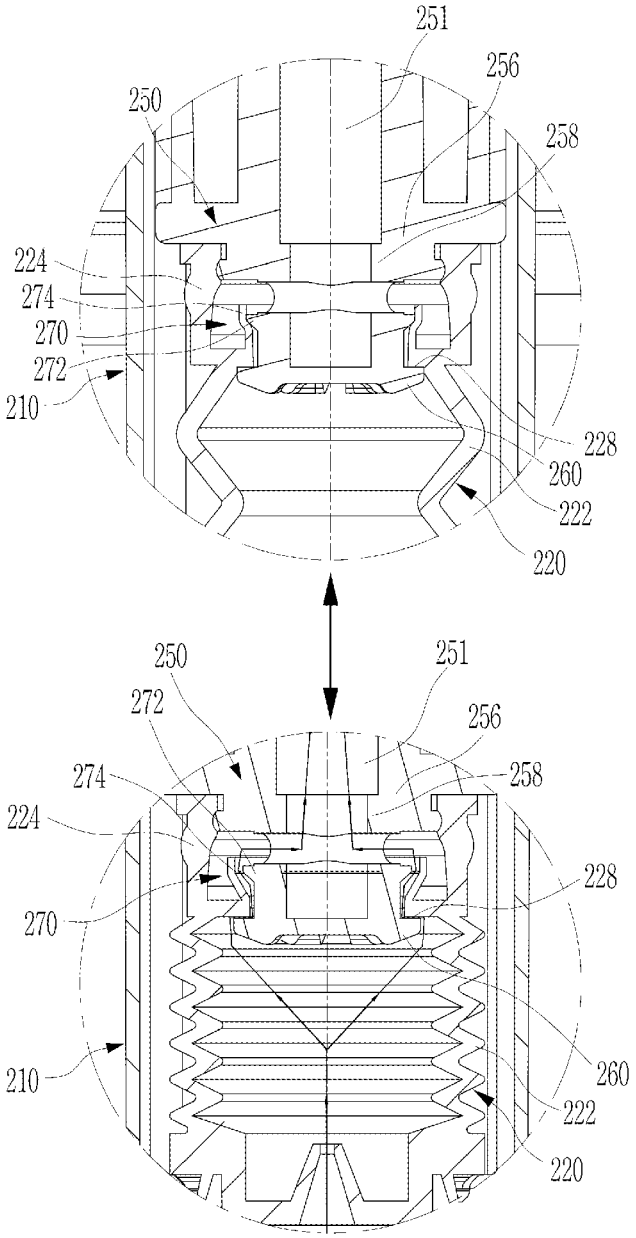
FIG. 6 is a schematic view illustrating a pumping apparatus according to another embodiment.

FIG. 6 illustrates a pumping apparatus according to another embodiment.

As illustrated in FIG. 6, the pumping apparatus 200 according to the embodiment may further include an inner sealing portion 270 configured to increase airtightness between the pumping member 220 and the nozzle member 250 to prevent leakage of the contents.

In the following description, since the constituent parts of the pumping apparatus are the same as the above-described structure except for the inner sealing portion 270, the same elements will be denoted by the same reference numerals, and detailed description thereof will be omitted.

The inner sealing portion 270 additionally blocks a contents discharge path inside the mounting portion 224 of the pumping member 220. Thus, the inside of the pumping member 220 is firstly blocked by the undercut portion 228 and the valve seat 260 and is secondly blocked by the inner sealing portion 270. Therefore, even in a case in which the undercut portion 228 is deformed due to the outside temperature or the like and is not pressed against the valve seat 260, leakage of the contents may be prevented by the inner sealing portion 270.

The inner sealing portion 270 may include a protruding portion 272 formed on the fitting portion 256 of the nozzle member 250 and an inner wall 274 formed inside the mounting portion of the pumping member and pressed against the protruding portion 272.

The protruding portion 272 may be continuously formed along an outer circumferential surface of the fitting portion 256. The protruding portion 272 is formed to protrude outward from the outer circumferential surface of the fitting portion 256. In the embodiment, the protruding portion 272 may be formed below the inflow hole 258 of the fitting portion 256. Thus, the contents may be blocked by the protruding portion 272 and the inner wall 274 and prevented from flowing out through the inflow hole 258.

A front end at an outer side of the protruding portion 272 comes in contact with and is pressed against the inner wall 274. A lower end of the protruding portion 272 forms an inclined surface toward the fitting portion 256. Thus, when the fitting portion 256 of the nozzle member 250 is fitted and coupled to the mounting portion 224 of the pumping member 220, the protruding portion 272 may easily be inserted into the inner wall 274.

The inner wall 274 may be integrally formed with an upper end of the undercut portion 228 and disposed in a space inside the mounting portion 224. The inner wall 274 is formed to extend upward from the upper end of the undercut portion 228 and has a cylindrical shape with an open upper end. The inner wall 274 is formed to be spaced apart from an inner surface of the mounting portion 224. Thus, the inner wall 274 may be elastically deformed in a gap between the inner wall 274 and the inner surface of the mounting portion 224.

In the embodiment, since an inner diameter of the inner wall 274 having a cylindrical shape is relatively smaller than a diameter of the protruding portion 272, the inner wall 274 may be elastically pressed against the protruding portion 272.

Thus, the inner wall 274, which is pressed against the protruding portion 272, may prevent leakage of the contents through the inflow hole 258. Also, when the pumping member 220 is compressed for discharge of the contents, due to the pressure inside the pressure portion 222, the inner wall 274 is elastically deformed and expands outward, and a portion between the protruding portion 272 and the inner wall 274 is widened and opened. Therefore, the contents may be smoothly discharged toward the inflow hole 258 through the portion between the inner wall 274, which is elastically deformed outward, and the protruding portion 272.

That is, as the mounting portion 224 is elastically compressed due to the pumping member 220 being compressed, first, the portion between the undercut portion 228 and the valve seat 260 is opened first. Thus, the contents move upward from the pressure portion through the open portion between undercut portion 228 and the valve seat 260 and apply pressure to the inner wall 274. Also, as the inner wall 274 is elastically deformed and expands outward due to the pressure of the contents, the portion between the inner wall 274 and the protruding portion 272 is opened. Therefore, the contents may be discharged to the inflow hole 258 through the portion between the inner wall 274 and the protruding portion 272 which are spaced apart from each other.

Meanwhile, when the discharge of the contents is completed and the pumping member 220 is restored to its original state, the mounting portion 224, which has been compressed, is restored to its original state due to an elastic restoration force, and thus the nozzle member 250 moves upward, and the valve seat 260 comes in close contact with the undercut portion 228.

The inner wall 274 is also restored to its original state due to an elastic restoration force while not receiving the pressure caused by the contents and comes in close contact with the protruding portion 272.

Thus, since a contents discharge flow path between the pressure portion and the inflow hole 258 is tightly blocked in multiple stages by the undercut portion 228 and the valve seat 260 and by the inner wall 274 and the protruding portion 272, leakage of the contents may be effectively prevented.

According to one aspect of the present disclosure, in a cosmetic container having a structure in which atmospheric air enters the container, since a nozzle member and a pumping member are manufactured as a single component, the number of components can be reduced, and the structure can be further simplified.

Using the simple structure, atmospheric air can smoothly circulate into the cosmetic container, leakage of cosmetics can be prevented, and the cosmetics can be easily discharged.

Since manufacturing is easy and manufacturing costs can be reduced, the price competitiveness of the product can be increased.

The exemplary embodiment of the present disclosure has been described above, but various modifications and other embodiments may be made by those of ordinary skill in the art. It should be noted that the modifications and other embodiments are included in the scope of the attached claims and do not depart from the true intent and scope of the present disclosure.

What is claimed is:

1. A cosmetic container comprising:

a container main body in which contents are accommodated;

a pumping apparatus coupled to an opening at an upper end of the container main body and configured to discharge the contents accommodated in the container main body through a pumping action caused by the inherent elasticity of the pumping apparatus;

a discharge head which is connected to the pumping apparatus to apply a discharge pressure to the pumping apparatus and has an outlet provided at a front end to communicate with the pumping apparatus and allow the contents to exit; and an inflow tube which is connected to the pumping apparatus and extends to an inner bottom of the container main body to allow the contents to enter, wherein the pumping apparatus includes a housing which is tightly mounted on the opening and in which an operating chamber and a cylinder chamber having different inner diameters are sequentially disposed in an axial direction, a pumping member which is provided in the housing, forms a contents accommodation space, is inherently elastically compressed or expanded in the axial direction to transfer the contents in one direction, and selectively opens or closes a gap between the housing and the pumping member to allow outside air to enter the container main body, and a nozzle member which is installed to be vertically movable in the operating chamber at an upper portion of the housing and has an upper end connected to the discharge head, a lower end coupled to the pumping member, and a duct through which the contents move formed therein to, according to manipulation of the discharge head, compress the pumping member and selectively open or close between the duct and the space of the pumping member, wherein the pumping member includes a skirt portion which is integrally formed with an outer circumferential surface of a lower portion thereof and which has an outer diameter gradually increasing toward a lower end thereof to be elastically pressed against an inner surface of the cylinder chamber of the housing so that outside air enters the container main body.

2. The cosmetic container of claim 1, wherein the pumping member includes a pressure portion which forms a space therein and is compressed and elastically restored by an external force such that a pressure of the space therein is changed, a mounting portion which is integrally formed with an upper end of the pressure portion and tightly coupled to the nozzle member, a flange which is formed to protrude outward from an outer circumferential surface of a lower portion of the pressure portion and which is pressed against a step between the operating chamber and the cylinder chamber of the housing, a connecting shaft which is formed to extend from a lower end of the pressure portion in the axial direction and which is connected to the inflow tube, a check valve which is integrally formed with an inner side of the lower portion of the pressure portion to allow the contents to enter in one direction from the container main body toward the inside of the pressure portion, an undercut portion which is formed as a step in an inner circumferential surface of a lower end of the mounting portion so that a lower inner diameter is larger than an upper inner diameter and which comes in close contact with the nozzle member to block between the pressure portion and the duct inside the nozzle member, an elastic portion which is integrally formed with the mounting portion and which is compressed and elastically restored by an external force to open or close between the undercut portion and the nozzle member, and a skirt portion which is integrally formed with the outer circumferential surface of the lower portion of the pressure portion and which has an outer diameter gradually increasing toward a lower end thereof to be elastically pressed against an inner surface of the cylinder chamber of the housing.

3. The cosmetic container of claim 1, wherein the pumping member is made of silicone, rubber, or a synthetic resin.

4. The cosmetic container of claim 2, wherein, in the pumping member, an elastic modulus of the elastic portion is relatively higher than an elastic modulus of the pressure portion such that the pressure portion is deformed before the elastic portion when an external force is applied.

5. The cosmetic container of claim 2, wherein the nozzle member includes a nozzle body which is fitted to the operating chamber of the housing and installed to be movable along the operating chamber and which has a duct formed therein to transfer the contents, a connection tube which extends in the axial direction at an upper end of the nozzle body, has the duct formed therein, and is coupled to the discharge head, a fitting portion which is formed at a lower end of the nozzle body and which is fitted to the mounting portion of the pumping member to be tightly coupled thereto, an inflow hole which is formed in a side surface of the fitting portion to allow the duct to communicate with the inside of the elastic portion of the pumping member, and a valve seat which is integrally formed with a lower end of the fitting portion to block a front end of the duct and which comes in close contact with the undercut portion of the pumping member to block between the pressure portion and the elastic portion.

6. The cosmetic container of claim 2, wherein, at a portion which is formed at the step of the housing and comes in contact with the flange of the pumping member, one or more trench grooves are formed at predetermined intervals to form a gap with the flange and allow air to enter.

7. The cosmetic container of claim 6, wherein a rim portion which comes in close contact with the flange is formed along an inner side circumference of the step of the housing, and the trench groove is formed to extend along the rim portion.

8. The cosmetic container of claim 5, further comprising an inner sealing portion configured to increase airtightness between the pumping member and the nozzle member to prevent leakage of the contents.

9. The cosmetic container of claim 8, wherein the inner sealing portion includes a protruding portion which is formed along an outer circumferential surface of the fitting portion and protrudes outward below the inflow hole of the nozzle member and an inner wall which is provided in a space inside the mounting portion of the pumping member, is spaced apart from an inner surface of the mounting portion, and is formed to extend upward from an upper end of the undercut portion to be pressed against the protruding portion and be elastically deformed so that a portion between the protruding portion and the inner wall is opened or closed.

10. A pumping apparatus of a cosmetic container including a container main body in which contents are accommodated, a pumping apparatus coupled an opening at an upper end of the container main body and configured to discharge the contents accommodated in the container main body through a pumping action caused by the inherent elasticity of the pumping apparatus, a discharge head which is connected to the pumping apparatus to apply a discharge pressure to the pumping apparatus and has an outlet provided at a front end to communicate with the pumping apparatus and allow the contents to exit, and an inflow tube which is connected to the pumping apparatus and extends to an inner bottom of the container main body to allow the contents to enter, the pumping apparatus comprising:

a housing which is tightly mounted on the opening and in which an operating chamber and a cylinder chamber having different inner diameters are sequentially disposed in an axial direction;

a pumping member which is provided in the housing, forms a contents accommodation space, is inherently elastically compressed or expanded in the axial direction to transfer the contents in one direction, and selectively opens or closes a gap between the housing and the pumping member to allow outside air to enter the container main body; and a nozzle member which is installed to be vertically movable in the operating chamber at an upper portion of the housing and has an upper end connected to the discharge head, a lower end coupled to the pumping member, and a duct through which the contents move formed therein to, according to manipulation of the discharge head, compress the pumping member and selectively open or close between the duct and the space of the pumping member, wherein the pumping member includes a skirt portion which is integrally formed with the outer circumferential surface of the lower portion of the pressure portion and which has an outer diameter gradually increasing toward a lower end thereof to be elastically pressed against an inner surface of the cylinder chamber of the housing.

11. The pumping apparatus of claim 10, wherein the pumping member includes a pressure portion which forms a space therein and is compressed and elastically restored by an external force such that a pressure of the space therein is changed, a mounting portion which is integrally formed with an upper end of the pressure portion and tightly coupled to the nozzle member, a flange which is formed to outwardly protrude from an outer circumferential surface of a lower portion of the pressure portion and which is pressed against a step between the operating chamber and the cylinder chamber of the housing, a connecting shaft which is formed to extend from a lower end of the pressure portion in the axial direction and which is connected to the inflow tube, a check valve which is integrally formed with an inner side of the lower portion of the pressure portion to allow the contents to enter in one direction from the container main body toward the inside of the pressure portion, an undercut portion which is formed as a step in an inner circumferential surface of a lower end of the mounting portion so that a lower inner diameter is larger than an upper inner diameter and which comes in close contact with the nozzle member to block between the pressure portion and the duct inside the nozzle member, an elastic portion which is integrally formed with the mounting portion and which is compressed and elastically restored by an external force to open or close between the undercut portion and the nozzle member.

12. The pumping apparatus of claim 11, wherein the pumping member is made of silicone, rubber, or a synthetic resin.

13. The pumping apparatus of claim 11, wherein the nozzle member includes a nozzle body which is fitted to the operating chamber of the housing and installed to be movable along the operating chamber and which has a duct formed therein to transfer the contents, a connection tube which extends in the axial direction at an upper end of the nozzle body, has the duct formed therein, and is coupled to the discharge head, a fitting portion which is formed at a lower end of the nozzle body and which is fitted to the mounting portion of the pumping member to be tightly coupled thereto, an inflow hole which is formed in a side surface of the fitting portion to allow the duct to communicate with the inside of the elastic portion of the pumping member, and a valve seat which is integrally formed with a lower end of the fitting portion to block a front end of the duct and which comes in close contact with the undercut portion of the pumping member to block between the pressure portion and the elastic portion.

14. The pumping apparatus of claim 11, wherein, at a portion which is formed at the step of the housing and comes in contact with the flange of the pumping member, one or more trench grooves are formed at predetermined intervals to form a gap with the flange and allow air to enter.

15. The pumping apparatus of claim 14, wherein a rim portion which comes in close contact with the flange is formed along an inner side circumference of the step of the housing, and the trench groove is formed to extend along the rim portion.

16. The pumping apparatus of claim 13, further comprising an inner sealing portion configured to increase airtightness between the pumping member and the nozzle member to prevent leakage of the contents.

17. The pumping apparatus of claim 16, wherein the inner sealing portion includes a protruding portion which is formed along an outer circumferential surface of the fitting portion and protrudes outward below the inflow hole of the nozzle member and an inner wall which is provided in a space inside the mounting portion of the pumping member, is spaced apart from an inner surface of the mounting portion, and is formed to extend upward from an upper end of the undercut portion to be pressed against the protruding portion and be elastically deformed so that a portion between the protruding portion and the inner wall is opened or closed.

* * * * *